US006063014A

United States Patent [19]

Scoggins

[11] Patent Number: 6,063,014

[45] Date of Patent: May 16, 2000

[54] PORTABLE EXERCISE DEVICE

[76] Inventor: H. Alton Scoggins, 935 Hillside Mill Dr., Grayson, Ga. 30017

[21] Appl. No.: 09/292,047

[22] Filed: Apr. 14, 1999

[51] Int. Cl.[7] ..... A63B 21/02

[52] U.S. Cl. ..... 482/121; 122/905

[58] Field of Search ..... 482/121, 122, 482/123, 129, 905, 136, 142, 904, 103; D21/677

[56] References Cited

U.S. PATENT DOCUMENTS

| | | | |
|---|---|---|---|
| D. 263,160 | 2/1982 | Blackmon . | |
| D. 355,458 | 2/1995 | Chen . | |
| 3,633,907 | 1/1972 | Cane | 482/905 |
| 3,885,789 | 5/1975 | Deluty et al. . | |
| 3,893,667 | 7/1975 | Snyder, Jr. et al. . | |
| 3,995,853 | 12/1976 | Deluty . | |
| 4,077,626 | 3/1978 | Newman . | |
| 4,114,875 | 9/1978 | Deluty . | |
| 4,129,297 | 12/1978 | Dolan | 482/905 |
| 4,557,480 | 12/1985 | Dudley . | |
| 4,603,857 | 8/1986 | Chipman et al. | 482/905 |
| 4,611,805 | 9/1986 | Franklin et al. . | |
| 4,645,204 | 2/1987 | Berger . | |
| 5,087,038 | 2/1992 | Hao | 482/905 |
| 5,184,994 | 2/1993 | Morris et al. | 482/124 |
| 5,261,864 | 11/1993 | Fitzpatrick . | |
| 5,403,257 | 4/1995 | Lehtonen | 482/142 |
| 5,514,058 | 5/1996 | Buoni et al. . | |
| 5,681,249 | 10/1997 | Endleman | 482/142 |
| 5,720,702 | 2/1998 | Lee | 482/129 |
| 5,895,343 | 4/1999 | Huang | 482/123 |

*Primary Examiner*—Jerome W. Donnelly

*Attorney, Agent, or Firm*—Hinkle & Associates, P.C.

[57] ABSTRACT

A new and improved portable exercise device 10, wherein a user can perform a multitude of exercises to condition numerous muscle groups of the body. The present device comprises, generally, a base 20, an armrest 40, a pulley system 60 and a variety of handles and straps. More specifically, the pulley system is carried by the base and comprises a resistance cord 62 attached to a peg 80 at the distal end of the base and extends the length of the base to the proximal end of the base. To guide the resistance cord over the base a track 72 is attached to the base wherein the resistance cord is channeled through the track. Attached to the proximal end of the base is a pulley 66. The resistance cord is channeled through the pulley which serves to provide a rotatable means for securing the resistance cord at the proximal end of the base to facilitate a multitude of vertically-angled exercises. The armrest can be hinged upward from the base and secured in an angled position by a prop 50 carried within the armrest. This angled armrest position facilitates certain exercises such as the "preacher curl". The base is hollow with a removable bottom cover 15 to allow the storage and retrieval of numerous accessories such as a single handle, a double handle 105, a leg strap 115, extension chains 110 and resistance cords 62 having varying degrees of resistance. To increase or decrease the degree of resistance, a resistance cord can be removed from the peg and replaced with a resistance cord having greater or lesser resistance as desired. As needed for the desired exercise, the single handle, double handle or leg strap may be removably attached to the proximal end of the resistance cord. Additionally, extension chains 110 may be added as necessary.

19 Claims, 3 Drawing Sheets

PORTABLE EXERCISE DEVICE

BACKGROUND OF THE INVENTION

I. Field of the Invention

The present invention relates generally to the field of exercising equipment, and, more particularly, to a new and improved portable multi-function exercise device.

II. Description of the Related Art

Due to the widely accepted benefits of exercise, a multitude of exercise devices have been proposed. However, in light of the present invention, these prior designs are deficient in one or more areas. For instance, exercise equipment tends to be bulky and/or heavy and thus difficult to store. Additionally, because of the size of the equipment and/or weight of the equipment, it typically lacks the ability to be portable. Examples of such devices may be found by reference to U.S. Pat. No. 5,261,864 to Fitzpatrick, U.S. Pat. No. 4,077,626 to Newman and U.S. Pat. No. 3,893,667 to Snyder, Jr. et al.

An additional deficiency of previously designed exercise equipment is the higher level of complexity needed to achieve the same multifunction benefits as the present invention, thereby resulting in the need for additional parts and thus increasing both the weight and costs of such equipment. Examples of such devices may be found by reference to U.S. Pat. No. 4,114,875 to Deluty, U.S. Pat. No. 3,995,853 to Deluty, U.S. Pat. No. 3,893,667 to Snyder, Jr. et al and U.S. Pat. No. 3,885,789 to Deluty et al.

Attempts have been made to overcome some of these deficiencies. Examples of such attempts may be found by reference to U.S. Pat. No. 5,514,058 to Buoni et al., U.S. Pat. No. 4,645,204 to Berger, U.S. Pat. No. 4,611,805 to Franklin et al., U.S. Pat. No. 4,557,480 to Dudley, U.S. Pat. No. D355,458 to Chen and U.S. Pat. No. D263,160 to Blackmon. However, many of these designs do not allow for a multitude of exercising positions and thus, limit the number of muscle groups capable of adequately benefiting from the respective devices.

It is readily apparent that a new and improved portable exercise device is needed to overcome the disadvantages just described. It is, therefore, to the provision of such an improved portable exercise device that the present invention is directed.

SUMMARY OF THE INVENTION

In accordance with the present invention and the contemplated problems which have and continue to exist in this field, there is presented a new and improved portable exercise device, wherein a user can perform a multitude of exercises to condition numerous muscle groups of the body. The present device comprises, generally, a base, an armrest, a pulley system and a variety of handles and straps. More specifically, the pulley system is carried by the base and comprises a resistance cord attached to a peg at the distal end of the base and extends the length of the base to the proximal end of the base. To guide the resistance cord over the base a track is attached to the base wherein the resistance cord is channeled through the track. Attached to the proximal end of the base is a pulley. The resistance cord is channeled through the pulley which serves to provide a rotatable means for securing the resistance cord at the proximal end of the base to facilitate a multitude of vertically-angled exercises.

The armrest can be hinged upward from the base and secured in an angled position by a prop carried within the armrest. This angled armrest position facilitates certain exercises such as the "preacher curl".

The base is hollow with a removable bottom cover to allow the storage and retrieval of numerous accessories such as a single handle, a double handle, a leg strap, extension chains and resistance cords having varying degrees of resistance. To increase or decrease the degree of resistance, a resistance cord can be removed from the peg and replaced with a resistance cord having greater or lesser resistance as desired. As needed for the desired exercise, a single handle, a double handle or a leg strap may be removably attached to the proximal end of the resistance cord. Additionally, extension chains may be added as necessary.

To provide means for holding the exercise device down during use, two support arms and a hinge are attached to the base. The two support arms are removably attached to allow removal during storage and/or movement of the exercise device. The hinge comprises hook and loop fastener attached to the facing surfaces of the hinge portions to removably secure the hinge in a closed position during storage and/or movement of the exercise device. The two support arms allow the user to stand on the arms during exercises in which the userfaces parallel to the exercise device in order to maintain the device firmly against the floor. The hinge is used by the user typically during exercises in which the user faces perpendicular to the exercise device and stands on the hinge to maintain the device firmly against the floor.

A feature and advantage of the present invention is to provide a new and improved exercise device that is lightweight and portable yet provides a multitude of exercises for conditioning several muscle groups of the body.

Another object of the present invention is to provide a new and improved exercise device having an adjustable armrest.

Another feature and advantage of the present invention is to provide a new and improved exercise device having a hollow base for storage of accessories.

A further advantage of the present invention is to provide a new and improved exercise device having a multitude of elastic cords with varying degrees of resistance.

Another feature and advantage of the present invention is to provide a new and improved exercise device having a plurality of accessories such as a single handle, a double handle, a leg strap and extension chains.

Other objects, advantages and capabilities of the invention will become apparent from the following description taken in conjunction with the accompanying drawings showing the preferred embodiment of the invention.

DESCRIPTION OF THE PREFERRED EMBODIMENT

Figure 1:
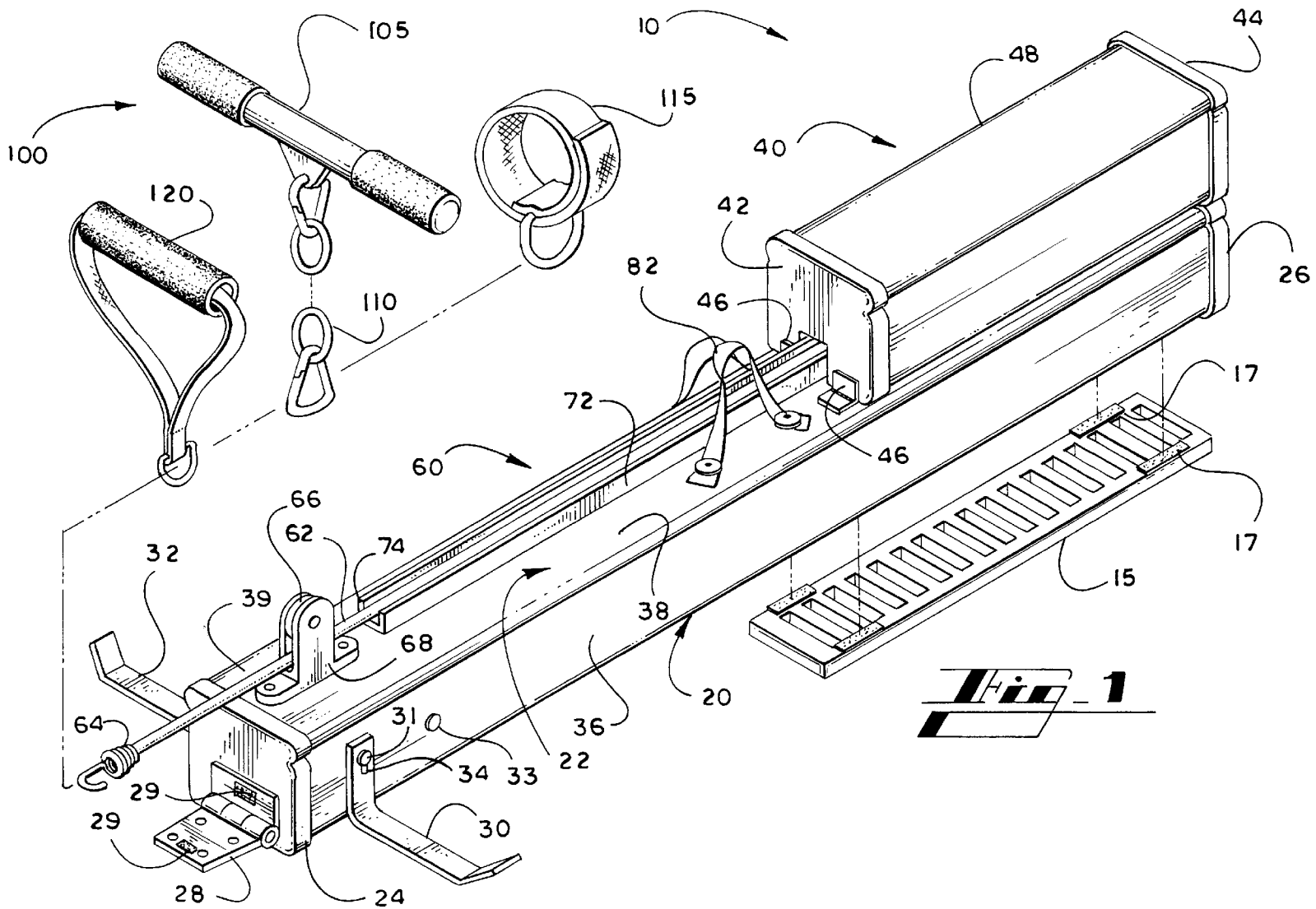
FIG. 1 is a perspective exploded view of a preferred embodiment of the present invention.
Figure 2:
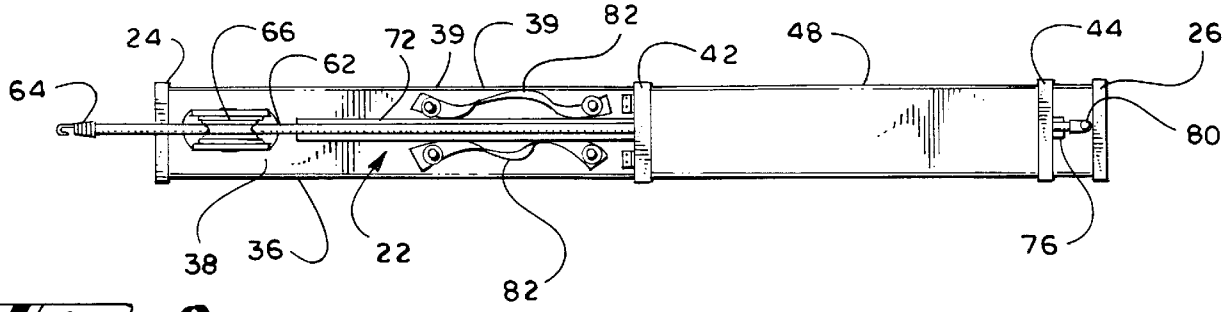
FIG. 2 is a top view of a preferred embodiment of the present invention.
Figure 3:
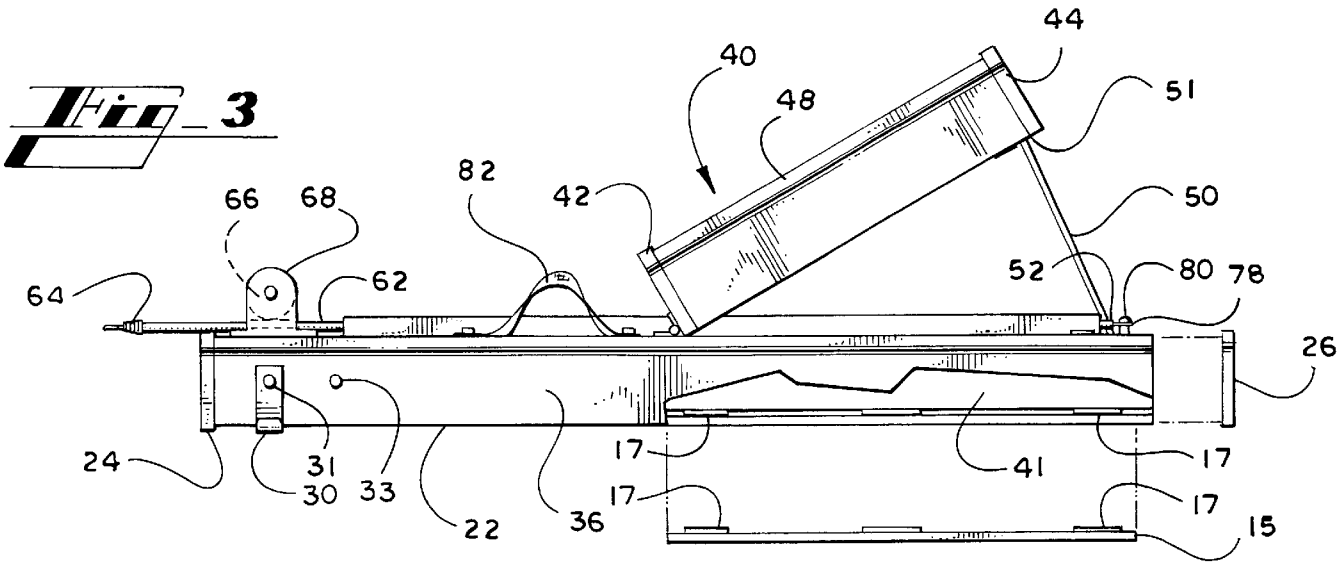
FIG. 3 is a side view of a preferred embodiment of the present invention.
Figure 4:
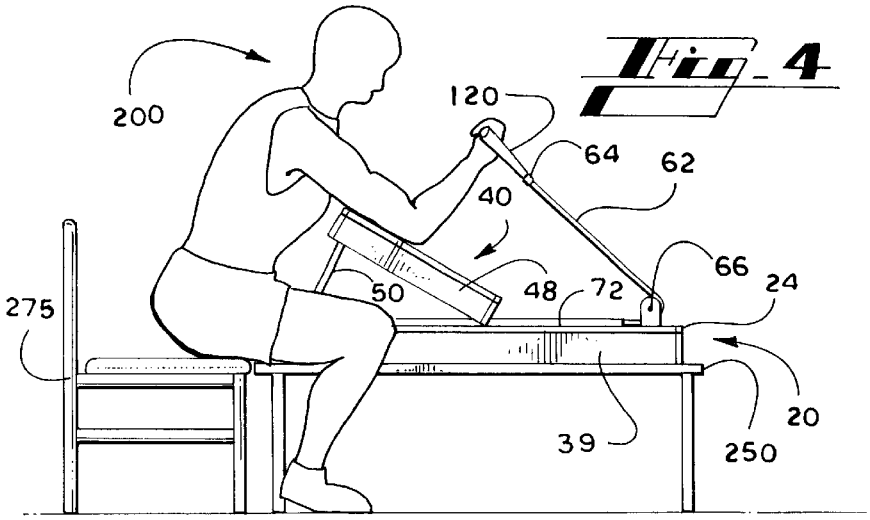
FIG. 4 is an elevation view of a user using the invention on a table top performing a preacher curl.
Figure 5:
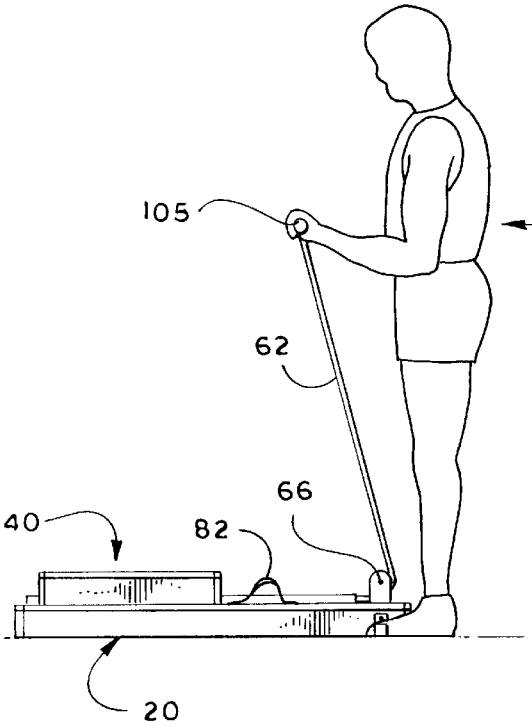
FIG. 5 is an elevation view of a user using the invention performing a standing curl.
Figure 6:
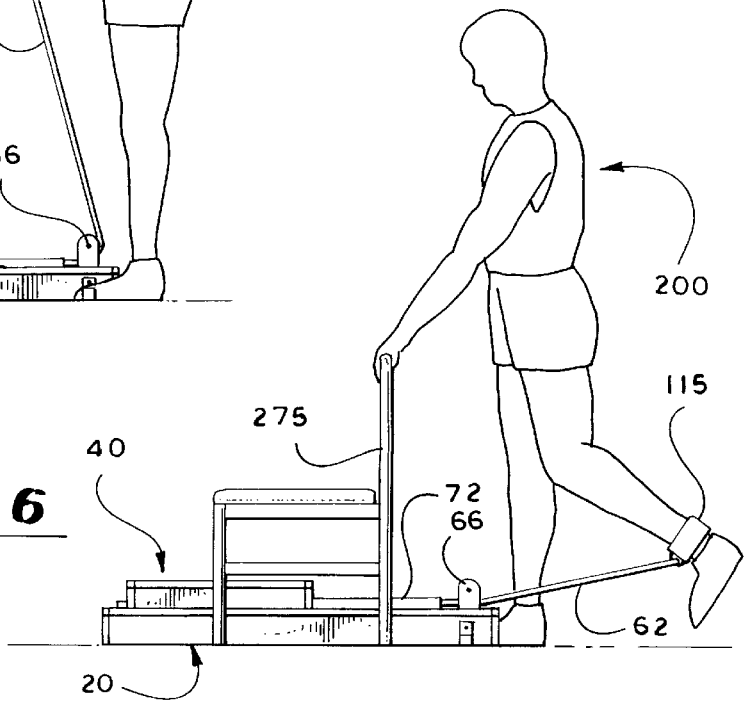
FIG. 6 is an elevation view of a user using the invention performing a standing leg curl.

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIGS. 1–3.

A preferred embodiment of the present invention is generally, indicated by reference numeral 10. Device 10 comprises preferably base unit 20, armrest assembly 40, pulley system 60 and accessories 100.

More specifically, base unit 20 comprises elongated member 22, first end cap 24, second end cap 26, base hinge 28, first support arm 30, second support arm 32. Elongated member 22 is generally rectangular shape and is defined by first side wall 36 and second side wall 39 connected by top wall 38 and bottom storage cover 15. Storage cover 15 is removably attached via hook and loop fasteners 17 to the bottom of elongated member 22 to allow access to the hollow portion 41 of elongated member 22 for storage and retrieval of accessories such as ankle strap 115, double handle 105, single handle 120, extension chain 110 and additional resistance cords 62. Attached on the distal end of elongated member 22 is second end cap 26 dimensioned for snugly receiving the distal ends of first side wall 36, second side wall 39 and top wall 38. Attached to the proximal end of elongated member 22 is first end cap 24 dimensioned for snugly receiving the proximal ends of first side wall 36, second side wall 39 and top wall 38. Attached to the outer surface of first end cap 24 is base hinge 28. In use, when a user is performing an exercise in which he faces perpendicular to device 10, he places one of his feet on the opened base hinge 28 to assist in securing device 10 in position during use. Hook and loop fasteners 29 are attached on each portion of base hinge 28 to secure base hinge 28 in a closed position during storage and/or movement of device 10 to prevent interference therewith. To assist in holding device 10 in position, and to provide lateral support to the device 10, when a user is performing exercises in which he faces parallel to device 10, first support arm 30 and second support arm 32 are removably attached to first side wall 36 and second side wall 39, respectively, in proximity to first end cap 24. First support arm 30 and second support arm 32 are generally step shaped with one up-turned end of each having an aperture 34 formed therethrough for receiving the head of bolt 31. Bolt 31 is secured generally through the vertical center of the first side wall 36 and the second side wall 39 proximal to first end cap 24. During use, the bolt 31 is inserted through respective apertures 34 of first support arms 30 and 32, and slid downward to removably lock in position. The user, depending on the exercise being performed, places a respective foot on support arms 30 and 32 to hold device 10 in position during use. Additionally, the user may place his feet farther inward of device 10 by placing the support arms 30 and 32 at the locations on respective side walls 36 and 39 shown by spare mounting bolts 33. It should be noted that additional bolts could be attached at various locations to assist in providing a multitude of feet placement locations.

Armrest assembly 40 preferably comprises first end cap 42, second end cap 44, armrest hinges 46, armrest 48 and prop 50. Armrest 48 is generally the same shape as elongated member 22 of base unit 20. Armrest 48 is mounted on top of top wall 38 of base unit 20 and extends from second end cap 26 a predetermined distance toward first end cap 24. First end cap 42, dimensioned for receiving the proximal end of armrest 48, is attached thereto, and second end cap 44, dimensioned for receiving the distal end of armrest 48, is attached thereto. Attached to the outer surface of first end cap 42 of armrest assembly 40 are armrest hinges 46. Armrest hinges 46 serve to attach armrest assembly 40 to base unit 20 and to allow armrest assembly 40 to hinge upward from base unit 20. To secure armrest assembly 40 at an angle, first end 52 of prop 50 is pivotably attached to the interior of armrest 48 proximate to second end cap 44 such that when armrest assembly 40 is raised, second end 51 of prop 50 is used to prop the armrest into position. A plurality of apertures, dimples or grooves (not shown) are formed along the underneath area of top wall 38 and are dimensioned for receiving end 51 of prop 50 to allow armrest assembly 40 to be placed at a multitude of angles as desired by the user during specific exercises. For example, when performing "preacher curls", a user raises armrest assembly 40 to the desired angle and places second end 51 of prop 50 into the respective aperture, dimple or groove, thereby allowing him to rest his arm on armrest assembly 40 to perform the "preacher curl" exercise.

Pulley system 60, comprising generally resistance cord 62, first hook 64, second hook 78, track 72, pulley 66 and a pulley mounting bracket 68, serves to provide the resistance needed for various exercises. More specifically, resistance cord 62 is an elongated elastic cord having a first hook 64 attached to its proximal end and a second hook 78 attached to its distal end. Positioned on top wall 38 at the distal end of elongated member 22 proximal to second end cap 26 is peg 80. Peg 80 serves to removably receive and secure second hook 78 of resistance cord 62. Second hook 78 may be bolted to peg 80 or peg 80 may have an enlarged head with a neck dimensioned for receiving second hook 78. It should be noted that second hook 78 may be a ring or other suitable securing means in lieu of a hook.

Positioned on top wall 38 at the proximal end of elongated member 22 near first end cap 24 is pulley 66. Pulley 66 is mounted in position by mounting bracket 68 which is bolted or otherwise secured to top wall 38. Positioned between pulley 66 and peg 80 and extending the length therebetween is track 72. Track 72 is generally an elongated member having a bottom wall and two side walls thus forming a channel between the two side walls. Track 72 serves to guide resistance cord 62 between peg 80 and pulley 66. Resistance cord 62 is channeled between pulley 66 and mounting plate 68 and extends beyond end cap 24.

Accessories 100, comprising double handle 105, extension chain 110, leg strap 115 and single handle 120, are provided to allow a multitude of various exercises to be performed. Attached to each of accessories 100 is a ring or link that removably engages first hook 64 of resistance cord 62. Each of accessories 100 are interchangeable on first hook 64 depending on the desired exercise. For instance, for exercises requiring two hands, double handle 105 is utilized; for exercises requiring one hand, single handle 120 is utilized; and for leg exercises, leg strap 115 is utilized. Extension chain 110 may be added to any of accessories 100 to provide for proper positioning. It should be noted that a multitude of extension chains 110 having various lengths may be utilized to provide for a plurality of desired exercise positions.

Flexible handles 82 are secured to top wall 38 of base unit 20 on either side of track 72 and proximal to armrest assembly 40 to facilitate the lifting and movement of device 10. Additional resistance cords 62 having various resistances are provided to increase or decrease the level of difficulty of the various exercises.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. An exercise device, comprising:

a base, having a first end and a second end;

an elastic cord having a first end and a second end, said second end of said elastic cord removably attached to said second end of said base and extending over said base, wherein said first end of said elastic cord extends proximal to said first end of said base;

an armrest hinged to said base proximal to said second end of said base;

means carried by said armrest for propping said armrest at an angle relative to said base;

means for guiding said elastic cord over said base; and a pulley carried by said base proximal to said first end of said base, wherein said elastic cord is channeled through said pulley, and wherein a user can pull said first end of said elastic cord at various angles and positions to exercise various muscle groups.

2. The exercise device as claimed in claim 1, wherein said guiding means is a track having a channel for receiving said elastic cord.

3. The exercise device as claimed in claim 1, wherein said propping means is a rod having a first end and a second end and a plurality of grooves formed along the length of said base, said first end of said rod is pivotable attached to said armrest, wherein said rod pivots when said armrest is raised, and wherein said second end of said rod is placed in one of said plurality of grooves to secure said armrest at the desired angle.

4. The exercise device as claimed in claim 1, further comprising a first hook and a second hook, said first hook is secured to said first end of said elastic cord and said second hook is secured to said second end of said elastic cord, wherein said second hook is utilized to secure said second end of said elastic cord to said base.

5. The exercise device as claimed in claim 4, further comprising a handle removably attached to said first hook of said elastic cord.

6. The exercise device as claimed in claim 4, further comprising a leg strap removably attached to said first hook of said elastic cord.

7. The exercise device as claimed in claim 1, further comprising a handle attached to said base for carrying said exercise device.

8. The exercise device as claimed in claim 1, wherein said base is hollow and wherein said hollow area of said base is accessible to allow storage and retrieval of miscellaneous equipment.

9. The exercise device as claimed in claim 1, further comprising a first brace and a second brace attached to said base for providing support of said exercise device during use and for providing a surface for the user to step on to hold said exercise device down during use.

10. The exercise device as claimed in claim 1, further comprising a hinge having an open position and a closed position, said hinge attached to said base, said hinge having hook and loop fastener for securing said hinge in said closed position, wherein said hinge in said open position provides a surface for the user to step on to hold said exercise device down during use.

11. An exercise device, comprising:

a base, having a first end and a second end;

an elastic cord having a first end and a second end, said second end of said elastic cord removably attached to said second end of said base and extending over said base, wherein said first end of said elastic cord extends proximal to said first end of said base;

an armrest hinged to said base proximal to said second end of said base;

means carried by said armrest for propping said armrest at an angle relative to said base;

a track having a channel for receiving said elastic cord; and a pulley carried by said base proximal to said first end of said base, wherein said elastic cord is channeled through said pulley, and wherein a user can pull said first end of said elastic cord at various angles and positions to exercise various muscle groups.

12. The exercise device as claimed in claim 11, wherein said propping means is a rod having a first end and a second end and a plurality of grooves formed along the length of said base, said first end of said rod is pivotable attached to said armrest, wherein said rod pivots when said armrest is raised, and wherein said second end of said rod is placed in one of said plurality of grooves to secure said armrest at the desired angle.

13. The exercise device as claimed in claim 11, further comprising a first hook and a second hook, said first hook is secured to said first end of said elastic cord and said second hook is secured to said second end of said elastic cord, wherein said second hook is utilized to secure said second end of said elastic cord to said base.

14. The exercise device as claimed in claim 13, further comprising a handle removably attached to said first hook of said elastic cord.

15. The exercise device as claimed in claim 13, further comprising a leg strap removably attached to said first hook of said elastic cord.

16. The exercise device as claimed in claim 11, further comprising a handle attached to said base for carrying said exercise device.

17. The exercise device as claimed in claim 11, wherein said base is hollow and wherein said hollow area of said base is accessible to allow storage and retrieval of miscellaneous equipment.

18. The exercise device as claimed in claim 11, further comprising a first brace and a second brace attached to said base for providing support of said exercise device during use and for providing a surface for the user to step on to hold said exercise device down during use.

19. The exercise device as claimed in claim 11, further comprising a hinge having an open position and a closed position, said hinge attached to said base, said hinge having hook and loop fastener for securing said hinge in said closed position, wherein said hinge in said open position provides a surface for the user to step on to hold said exercise device down during use.

* * * * *